US007156883B2

(12) United States Patent
Lovasic et al.

(10) Patent No.: US 7,156,883 B2
(45) Date of Patent: Jan. 2, 2007

(54) LIGHTWEIGHT PROTECTIVE APPAREL

(75) Inventors: Susan L. Lovasic, Chester, VA (US); Surinder M. Maini, New Delhi (IN)

(73) Assignee: E. I. du Pont de Nemours and Company, Wilmington, DE (US)

( * ) Notice: Subject to any disclaimer, the term of this patent is extended or adjusted under 35 U.S.C. 154(b) by 70 days.

(21) Appl. No.: 10/899,462

(22) Filed: Jul. 26, 2004

(65) Prior Publication Data

US 2005/0277353 A1 Dec. 15, 2005

Related U.S. Application Data

(63) Continuation-in-part of application No. 10/635,189, filed on Aug. 6, 2003, now abandoned.

(51) Int. Cl.
*D06M 11/00* (2006.01)
*B32B 27/04* (2006.01)

(52) U.S. Cl. ..... 8/115.51; 8/115.7; 8/494; 428/364; 428/365; 428/920; 428/921; 442/136; 442/169

(58) Field of Classification Search ..... 442/136, 442/169; 428/920, 921, 364, 365; 8/115.51, 8/494, 115.7

See application file for complete search history.

(56) References Cited

U.S. PATENT DOCUMENTS

| | | | | |
|---|---|---|---|---|
| 3,063,966 | A | 11/1962 | Kwolek et al. | |
| 3,227,793 | A | 1/1966 | Cipriani | |
| 3,287,324 | A | 11/1966 | Sweeny | |
| 3,414,645 | A | 12/1968 | Morgan, Jr. | |
| 3,767,756 | A | 10/1973 | Blades | |
| 3,803,453 | A | 4/1974 | Hull | |
| 3,869,429 | A | 3/1975 | Blades | |
| 3,869,430 | A | 3/1975 | Blades | |
| 4,612,150 | A | 9/1986 | De Howitt | |
| 4,668,234 | A | 5/1987 | Vance et al. | |
| 4,755,335 | A | 7/1988 | Ghorashi | |
| 4,868,041 | A * | 9/1989 | Yamagishi et al. | 442/191 |
| 4,883,496 | A | 11/1989 | Ghorashi | |
| 5,096,459 | A | 3/1992 | Ghorashi | |
| 5,417,752 | A | 5/1995 | Paren et al. | |
| 5,609,950 | A | 3/1997 | Kampl et al. | |
| 5,667,743 | A | 9/1997 | Tai et al. | |
| 6,296,023 | B1 | 10/2001 | Gehrhardt et al. | |
| 6,607,562 | B1 | 8/2003 | Ghorashi et al. | |
| 2001/0008823 | A1 | 7/2001 | Ghorashi | |
| 2004/0045103 | A1 * | 3/2004 | Lunsford et al. | 8/531 |
| 2005/0130533 | A1 | 6/2005 | Lapierre | |

FOREIGN PATENT DOCUMENTS

| | | |
|---|---|---|
| EP | 0 228 026 A | 7/1987 |
| EP | 0 237 451 A | 9/1987 |
| EP | 0330 163 A | 8/1989 |
| EP | 0 432 100 A | 6/1991 |
| EP | 0 330 164 B1 | 8/1993 |

* cited by examiner

*Primary Examiner*—Ula C. Ruddock

(57) ABSTRACT

This invention relates to a blend of fibers for use in protective clothing, a lightweight fabric made from such blend, protective articles made from the blend or fabric, and methods for making the fabric. The protective fabrics and articles of this invention have the unique combination of being comfortable, being highly effective against electrical arcs and flash fire hazards and having a pleasing appearance. Specifically, these fabrics can be processed to give the look and feel similar to conventional clothing fabrics such as denim fabrics.

17 Claims, No Drawings

LIGHTWEIGHT PROTECTIVE APPAREL

RELATED APPLICATION

The present application is a continuation-in-part of Ser. No. 10/635,189 filed Aug. 6, 2003 now abandoned.

BACKGROUND OF THE INVENTION

1. Field of the Invention

This invention relates to a blend of fibers for use in protective clothing, a lightweight fabric made from such blend, protective articles made from the blend or fabric, and methods for making the fabric. The protective fabrics and articles of this invention have the unique combination of being comfortable, being highly effective against electrical arcs and flash fire hazards, and having a pleasing appearance. Specifically, these fabrics can be processed to give the look and feel similar to conventional clothing fabrics such as denim fabrics.

2. Description of Related Art

Several types of commercial products are used for protection against electrical arcs and flash fires. DIFCO Performance Fabrics, Inc., of Montreal, Quebec, Canada, offers for sale a dark blue fabric under the trade name of "Genesis" that is made entirely from Nomex® Type 462 staple fibers, which contain amorphous meta-aramid fibers. Southern Mills, Inc., of Union City, Ga., offers for sale solid shade spruce green protective fabrics under the trade names of "AtEase 950" and "Defender 950" that are also made entirely from Nomex® Type 462 staple fibers. These fabrics have good arc protection performance but are generally considered to not be as comfortable as traditional apparel fabrics since they are composed almost entirely of aramid fibers.

Southern Mills also offers for sale a royal blue protective fabric under the trade name of "ComfortBlend", which is made from an intimate blend of 35 percent by weight flame retardant rayon staple fibers and 65 percent by weight Nomex® Type 462 staple fibers, which contain amorphous meta-aramid fibers. The addition of the flame retardant rayon increases the comfort of this fabric at the expense of arc protection performance.

Workrite Uniform Company of Oxford, Calif., offers for sale a garment (Style #410-NMX-85-DN), described as a "denim jean cut pant". This garment is believed to be made from a fabric having Nomex® Type N-302 staple fibers (which contains crystallized meta-aramid fibers) in the warp direction of the fabric; and Nomex® Type T462 staple fibers (which contains amorphous meta-aramid fibers) in the fill direction. This fabric, while having good arc protection performance, does not have a pleasing appearance, and is generally not very comfortable since it is composed almost entirely of aramid fibers.

It is well known that aramid fabrics are more difficult to dye than traditional apparel fabrics, and the percent crystallinity of aramid fiber dramatically affects the degree to which the fiber may be dyed. The higher the crystallinity of the aramid fiber, the harder it is to dye. It is especially difficult to give such aramid fabrics the general appearance of a cotton denim fabric due to the differences in aramid fiber crystallinity. The simple addition of cotton, by blending cotton fiber with the meta-aramid fiber, does not provide a suitable solution to this problem. Cotton must be chemically treated to make it flame retardant. This is done in fabric form, which stiffens and reduces the suppleness of the fabric.

This makes any protective apparel made from this fabric less comfortable than apparel made from the untreated fabric.

What is needed is a fabric that not only has good electrical arc and flash fire performance but that also has the look and feel that approaches that of traditional fabrics like denim fabric.

SUMMARY OF THE INVENTION

This invention is related to a fiber blend for use in protective apparel, and a fabric and protective article made from the fiber blend. The fiber blend comprises amorphous meta-aramid fiber, crystallized meta-aramid fiber, and flame retardant cellulosic fiber. One embodiment of this invention relates to a fabric for protective apparel made from a first yarn comprising amorphous meta-aramid fiber and flame retardant cellulosic fiber and a second yarn comprising crystallized meta-aramid fiber and flame retardant cellulosic fiber. Preferably, the first and second yarns are present transverse each other in the fabric.

This invention also relates to a process for making a fabric for protective apparel by incorporating into a fabric a blend of fibers comprising amorphous meta-aramid fiber; crystallized meta-aramid fiber that is pigmented, dyed, or colored; and flame retardant cellulosic fiber; and then dyeing the fiber in the fabric. An embodiment of this process for making a fabric comprises incorporating in a fabric:

(i) a first yarn, comprising amorphous meta-aramid fiber and flame retardant cellulosic fiber, and (ii) a second yarn, comprising crystallized meta-aramid fiber that is pigmented, dyed, or colored and flame retardant cellulosic fiber, said first yarn being transverse the second yarn, and dyeing the fiber in the fabric.

Also, it has been unexpectedly discovered that improved arc protection can be obtained if the fabric after formation is dyed in two separate steps, one step for dyeing the flame retardant cellulosic fiber and a separate step for dyeing the meta-aramid fiber.

Accordingly, the present invention further is directed to a process for making a fabric for protective apparel, comprising:

a) incorporating in a fabric (i) a first yarn, comprising amorphous meta-aramid fiber and flame retardant cellulosic fiber, and (ii) a second yarn, comprising crystallized meta-aramid fiber and flame retardant cellulosic fiber, said first yarn being transverse the second yarn, and in either order.

b) dyeing the cellulosic fiber in the fabric;

c) dyeing the meta-aramid fiber in the fabric.

In a preferred embodiment of the present invention the fabric will have an electric arc protective rating (according to ASTM F-1959) of at least 1.30, and more preferably 1.40, calories per square centimeter calculated on a basis of ounces per square yard.

DETAILED DESCRIPTION OF THE INVENTION

This invention relates to a fiber blend, a protective fabric and method of making such fabric, and a protective article made from the combination of crystalline and amorphous meta-aramid fibers and flame retardant cellulosic fiber. The protective fabric and articles are particularly useful in the protection of workers from electrical arcs and flash fires.

By fiber blend it is meant the combination of two or more fiber types in any manner. This includes but is not limited to intimate blends and mixtures of at least two types of staple fiber; the simple combination of a staple yarn of one type of fiber with another staple yarn of another type of fiber; continuous multifilament yarns having two or more fiber types commingled in the yarn; and the simple combination of a continuous filament yarn of one type of fiber with another continuous filament yarn of another type of fiber. By "intimate blend" is meant that two or more fiber classes are blended prior to spinning a yarn.

The fiber blend is preferably made from staple fiber having staple lengths of up to 10 inches. Generally 50 to 85 weight percent and preferably 60 to 75 weight percent of the blend is made from meta-aramid fiber. Less than 50 weight percent is believed to not provide adequate electrical arc protection. Generally, the flame retardant cellulosic fiber should be present in the blend in an amount of 15 to 50 weight percent, preferably 25 to 40 weight percent, to insure the desired appearance of the fabric. Generally, the crystallized and amorphous meta-aramid fiber is present in substantially equal percentages however the actual balance can range from one-third to two-thirds of either meta-aramid component.

The fiber blend of this invention includes meta-aramid fibers, which are inherently flame retardant. By "aramid fiber" is meant one or more fibers made from one or more aromatic polyamides, wherein at least 85% of the amide (—CONH—) linkages are attached directly to two aromatic rings. Aromatic polyamides are formed by reactions of aromatic diacid chlorides with aromatic diamines to produce amide linkages in an amide solvent. Aramid fibers may be spun by dry or wet spinning using any number of processes, however, U.S. Pat. Nos. 3,063,966; 3,227,793; 3,287,324; 3,414,645; 3,869,430; 3,869,429; 3,767,756; and 5,667,743 are illustrative of useful spinning processes for making aramid fibers that could be used in this invention.

Two common types of aramid fibers include (1) meta-aramid fibers, one of which is composed of poly(metaphenylene isophthalamide), which is also referred to as MPD-I, and (2) para-aramid fibers, one of which is composed of poly(paraphenylene terephthalamide), also referred to as PPD-T. Meta-aramid fibers are currently available from E.I. du Pont de Nemours of Wilmington, Del. in several forms under the trademark Nomex®. Commercially available Nomex® T-450 is 100% meta-aramid fiber; Nomex® T-455 is a staple blend of 95% Nomex® meta-aramid fiber and 5% Kevlar® para-aramid fiber; and Nomex® T-462 is a staple blend of 93% Nomex® meta-aramid fiber, 5% Kevlar® para-aramid fiber, and 2% carbon core nylon fiber. Nomex® N302 is a staple blend of 93% producer colored Nomex® meta-aramid fiber, 5% producer colored Kevlar® para-aramid fiber, and 2% carbon core nylon fiber. In addition, meta-aramid fibers are available in various styles under the trademarks Conex® and Apyeil® which are produced by Teijin, Ltd. of Tokyo, Japan and Unitika, Ltd. of Osaka, Japan, respectively.

Meta-aramid fibers, when spun from solution, quenched, and dried using temperatures below the glass transition temperature, without additional heat or chemical treatment, develop only minor levels of crystallinity, and for the purposes of this invention are referred to as "amorphous" meta-aramid fiber. Such fibers have a percent crystallinity of less than 15 percent when the crystallinity of the fiber is measured using Raman scattering techniques. For the purposes of this invention, "crystallized" meta-aramid fibers are fibers that have a percent crystallinity of greater than 25 percent when crystallinity of the fiber is measured using Raman scattering techniques. As referred to herein, the meta-aramid fiber in Nomex® T-450 and Nomex® N302 has 26 to 30 percent crystallinity and is considered crystalline herein; the meta-aramid fiber in Nomex® T-462 and Nomex® T-455 has 5 to 10 percent crystallinity and is considered amorphous herein.

Amorphous meta-aramid fibers can be crystallized through the use of heat or chemical means. The level of crystallinity can be increased by heat treatment at or above the glass transition temperature of the polymer. Such heat is typically applied by contacting the fiber with heated rolls under tension for a time sufficient to impart the desired amount of crystallinity to the fiber. The level of crystallinity in the fiber can also be increased through chemical treatment of the fibers. Specifically, amorphous m-aramid fibers can be crystallized by dyeing the fibers in the presence of a dye carrier, the dye carrier being the active agent in increasing crystallinity. Further, the chemical action of the dye carrier can be used to increase the crystallinity to fibers that have already been heat treated, and are thus crystalline per the definitions herein.

The blend of crystalline and amorphous meta-aramid fiber is combined with flame retardant cellulosic fibers. Flame retardant cellulosic staple fibers are comprised of one or more cellulosic fibers and one or more flame retardant compounds. Cellulosic fibers, such as rayon, acetate, triacetate, and lyocell, which are generic terms for fibers derived from cellulose, are well known in the art. These fibers are cooler and have a higher moisture regain than aramid fibers, and comfortable apparel can be made from these fibers. Such flame retardant fibers are also readily dyed using conventional dyeing processes to make traditional-looking apparel fabrics.

Cellulosic fibers, although softer and less expensive than inherently flame retardant fibers, are not naturally resistant to flames. To increase the flame retarding capability of these fibers, one or more flame retardants are incorporated into or with the cellulosic fibers. Such flame retardants can be incorporated by spinning the flame retardant into the cellulosic fiber, coating the cellulosic fiber with the flame retardant, contacting the cellulosic fiber with the flame retardant and allowing the cellulosic fiber to absorb the flame retardant, or any other process that incorporates a flame retardant into or with a cellulosic fiber. There are a variety of such flame retardants, including, for example, certain phosphorus compounds, like Sandolast 9000®, currently available from Sandoz, certain antimony compounds, and the like. Generally speaking, cellulosic fibers that contain one or more flame retardants are given the designation "FR," for flame retardant. Accordingly, flame retardant cellulosic fibers such as FR rayon, FR acetate, FR triacetate, and FR lyocell may be used in the present invention. Flame retardant cellulosic fibers are also available under various trademarks, such as Visil®, which is available from Sateri Oy of Finland. Visil® fiber contains silicon dioxide in the form of polysilicic acid in a cellulose supporting structure wherein the polysilicic acid contains aluminum silicate sites. Methods for making this flame retardant cellulosic fiber is generally disclosed in, for example, U.S. Pat. No. 5,417,752. Another useful FR rayon is available from Lenzing AG under the name of Viscose FR (also known as Lenzing FR® available from Lenzing Fibers of Austria). Methods for making this flame retardant rayon fiber are generally disclosed in, for example, U.S. Pat. No. 5,609,950.

The preferred flame retardant cellulosic fiber is a flame retardant rayon. Rayon is well known in the art, and is a generic term for filaments made from various solutions of modified cellulose by pressing or drawing the cellulose solution. The cellulose base for the manufacture of rayon is obtained from wood pulp.

The fiber blend of this invention preferably contains, in addition, minor amounts of para-aramid fibers for increased flame strength and reduced thermal shrinkage. Para-aramid fibers are currently available under the trademarks Kevlar® from E.I. du Pont de Nemours of Wilmington, Del. and Twaron® from Teijin Ltd. of Tokyo, Japan. For the purposes herein, Technora® fiber, which is available from Teijin Ltd. of Tokyo, Japan, and is made from copoly(p-phenylene/3, 4'diphenyl ester terephthalamide), is considered a para-aramid fiber. Para-aramid fiber may be present in the fiber blend in amounts up to about 25 weight percent, however, it is preferred the para-aramid fiber be present in amounts of less than about 10 weight percent or lower.

The fiber blend of the present invention optionally further comprises about 1–5% by weight of a conductive fiber or filament rendered as such by the processes described in U.S. Pat. No. 4,612,150 (De Howitt) and U.S. Pat. No. 3,803,453 (Hull) wherein the conductive fiber comprises a fiber wherein carbon black or its equivalent is dispersed within it, which provides the anti-static conductance to the fiber. The preferred antistatic fiber is a carbon core nylon fiber. Integration of anti-static fibers into the present invention provides the fabrics made from the blend with an anti-static quality such that the fabric will have reduced static propensity, and therefore, reduced apparent electrical field strength and nuisance static.

One embodiment of this invention is a fabric comprising the fiber blend of crystallized and amorphous meta-aramid fiber and FR cellulosic fiber. The fiber blend can be incorporated into the fabric in many different ways. The preferred fabric is a woven fabric made from yarns. By "yarn" is meant an assemblage of fibers spun or twisted together to form a continuous strand, which can be used in weaving, knitting, braiding, or plaiting, or otherwise made into a textile material or fabric. Such yarns can be made by conventional methods for spinning staple fibers into yarns, such as, for example, ring-spinning, or higher speed air spinning techniques such as Murata air-jet spinning where air is used to twist the staple fibers into a yarn.

One method of incorporating the fiber blend into a fabric is by first blending the crystallized meta-aramid, the amorphous meta-aramid, and the FR cellulosic staple fibers together, along with any other desired staple fibers, to form an intimate blend of fibers, and then forming spun staple yarns using conventional techniques, such as forming a sliver of an intimate blend of the staple yarns, and then spinning the sliver into a yarn using such processes as ring or air-jet spinning. An alternate method to blend the fibers in the fabric is to make a single staple yarn containing crystallized meta-aramid staple fibers and FR cellulosic fibers, but no amorphous meta-aramid fibers. This single yarn is then plied with a single staple yarn containing amorphous meta-aramid staple fibers and FR cellulosic fibers, but no crystallized meta-aramid fibers.

Another alternate, and preferred method is to ply two of the single staple yarns of the same type together and incorporate this first plied yarn, having FR cellulosic fiber and only crystalline or amorphous meta-aramid fiber, in the warp or fill direction of the fabric. A second plied yarn, made from the other type of meta-aramid fiber and FR cellulosic fiber, is then used in the fabric direction transverse the first plied yarn. It is preferred that the plied yarn containing the crystalline meta-aramid fiber be used in the warp direction of the fabric while the plied yarn containing the amorphous meta-aramid fiber be used in the fill direction; and generally it is preferred that the crystalline meta-aramid plied yarn be finer than the amorphous meta-aramid fill yarn. These methods are not intended to be limited and other methods of incorporating staple fibers into fabrics are possible. All of these staple yarns can be made with and contain other fibers as long as product performance is not dramatically compromised.

Another method of incorporating the fiber blend into a fabric is by commingling continuous filaments to form a commingled multifilament yarn. Still another method is to form individual continuous multifilament yarns of one fiber component and combining that yarn with individual multifilament yarns of the other fiber components. All of these continuous filament yarns can also contain other types of filaments. These methods are not intended to be limited and other methods of incorporating continuous filaments into fabrics are possible.

The desired heather appearance and aesthetic appeal of the fabric of this invention is made more distinct by the use of staple fiber yarns, and the preferred arrangement of those staple yarns is to have staple yarns comprising crystalline fibers be transverse the staple yarns comprising amorphous fibers. Therefore, in traditional woven fabrics, the preferred arrangement is to have the crystalline fiber yarns in the warp with the amorphous fiber yarns in the fill, or to have the amorphous fiber yarns in the warp and the crystalline fiber yarns in the fill. Such an arrangement gives the most pleasing visual appearance to the fabric.

In the woven fabric, the crystalline m-aramid fibers may have been colored, pigmented, or dyed prior to being incorporated into the fabric. This can be achieved by methods for dyeing both crystalline and amorphous meta-aramid fiber disclosed in, for example, U.S. Pat. Nos. 4,668,234; 4,755,335; 4,883,496; and 5,096,459. It is also preferred that FR rayon fibers be included in both the warp and fill yarns. This fabric can then be dyed and made into garments, or alternatively, the fabric can be made into garments and the garments piece-dyed. A dye assist agent, also known as a dye carrier, is not generally needed to dye the FR cellulosic fibers but may be used to help increase dye pick up of the aramid fibers. By dyeing the fabrics with the use of a dye carrier the crystallinity of both the crystalline and amorphous meta-aramid fibers is increased. Useful dye carriers include aryl ether, benzyl alcohol, or acetophenone. After dyeing, the fabric is generally further stabilized to avoid laundry shrinkage using conventional processes used for cellulosic fibers. Such processes, one of which is Sanforizing®, are well known in the art.

However, unexpectedly improved arc protection has been observed if the fabric is dyed after formation with the meta-aramid fiber and the flame retardant cellulosic fiber dyed in separate steps. The meta-aramid fibers may be dyed as described in the proceeding paragraph such as with a cationic dye. The cellulosic fiber may be dyed in a conventional manner such as with a reactive dye. A typical reactive dye reacts with the fiber to produce a hydroxyl and oxygen linkage yielding a fast, brilliant color. In the case of cellulosic fiber, typically the bond is with hydroxyl groups present on cellulose molecules.

A preferred fabric of the present invention will have an electric arc protective rating of at least 1.30 and more preferably 1.40 calories per square centimeter calculated on a basis of ounces per square yard. The arc rating is determined in accordance with ASTM F-1959.

The fabrics of this invention are useful in and can be incorporated into protective garments, especially garments that have use in industrial applications where workers may be exposed to electrical arcs or flash fires. The garments may include coats, coveralls, jackets, shirts, pants, sleeves, aprons, and other types of apparel where protection against fire, flame, and heat is needed.

One embodiment of this invention is a process for making a fabric having a heather appearance comprising the steps of incorporating into a fabric a blend of amorphous and crystalline meta-aramid fibers and then dyeing the fabric. Preferably, the crystalline fibers are pigmented, dyed, or colored prior to being incorporated into the fabric.

The preferred process comprises incorporating the amorphous meta-aramid fibers in yarns that are transverse the crystalline meta-aramid yarns. For example, in a woven fabric the amorphous yarns can be in the fill and the crystalline yarns in the warp, or the crystalline yarns in the fill and the amorphous yarns in the warp.

After the fabric is made, it can be dyed using conventional dyeing processes using, for example, jet, beam, or jig dyeing equipment. The FR rayon fiber dyes easily with conventional dyes and processes; however, if the aramid is to be dyed a dye carrier is preferably used.

Test Methods

Electric arc protective ratings were obtained according to ASTM F-1959 to determine the Arc Thermal Performance Value (ATPV) of each fabric, which is a measure of the amount of energy that a person wearing that fabric could be exposed to that would be equivalent to a $2^{nd}$ degree burn from such exposure 50% of the time. Basis weight values were obtained according to FTMS 191A; 5041. Breaking strength values were obtained according to ASTM D-5034 (for grab test G). Tearing strength values were obtained according to ASTM D-5587 (for trap tear). Flash fire protection level testing was done according to ASTM F-1930 using an instrumented thermal mannequin with standard pattern coverall made with the test fabric.

The percent crystallinity of meta-aramids is determined by first generating a linear calibration curve for crystallinity using good, essentially non-voided samples. For such good non-voided samples the specific volume (1/density) can be directly related to crystallinity using a two-phase model. The density of the sample is measured in a density gradient column. A meta-aramid film, determined to be non-crystalline by x-ray scattering methods, was measured and found to have an average density of 1.3356 g/cm3. The density of a completely crystalline meta-aramid sample was then determined from the dimensions of the x-ray unit cell to be 1.4699 g/cm3. Once these 0% and 100% crystallinity end points are established, the crystallinity of any good (non-voided) experimental sample for which the density is known can be determined from this linear relationship:

$$\text{Crystallinity} = \frac{(1/\text{non-crystalline density}) - (1/\text{experimental density})}{(1/\text{non-crystalline density}) - (1/\text{fully-crystalline density})}$$

Since many fiber samples are not totally free of voids, Raman spectroscopy is the preferred method to determine crystallinity. Since the Raman measurement is not sensitive to void content, the relative intensity of the carbonyl stretch at $1650^{-1}$ cm can be used to determine the crystallinity of a meta-aramid in any form, whether voided or not. To accomplish this, a linear relationship between crystallinity and the intensity of the carbonyl stretch at 1650 $cm^{-1}$, normalized to the intensity of the ring stretching mode at 1002 $cm^{-1}$, was developed using minimally voided samples whose crystallinity was previously determined and known from density measurements as described above. The following empirical relationship, which is dependent on the density calibration curve, was developed for percent crystallinity using a Nicolet Model 910 FT-Raman Spectrometer:

$$\%\ \text{crystallinity} = 100.0 \times \frac{(I(1650\ cm^{-1}) - 0.2601)}{0.1247}$$

where $I(1650\ cm^{-1})$ is the Raman intensity of the meta-aramid sample at that point. Using this intensity the percent crystallinity of the experiment sample is calculated from the equation.

EXAMPLE 1

Fabric 1

Staple yarns were made from intimate blends of staple fiber having a nominal cut length of 2 inches. For the warp direction yarns, a staple blend containing 65% Nomex® Type N302 staple fibers and 35% FR Rayon staple fibers by weight of fiber was used. Nomex® Type N302 is a staple blend of 93% producer colored Nomex® (crystallized) meta-aramid fiber, 5% producer colored Kevlar® para-aramid fiber, and 2% carbon core nylon (anti-static) fiber. For the fill direction yarns, a staple blend containing 65% Nomex Type 462 staple fibers and 35% FR Rayon staple fibers by weight of fiber was used. Nomex® Type 462 is a staple blend of 93% natural color Nomex® (amorphous) meta-aramid fiber, 5% natural color Kevlar® para-aramid fiber, and 2% carbon core nylon (anti-static) fiber. The fiber blends were converted into plied yarns using an air jet spinning process followed by a plying step. The final yarn size was 24/2 cc for the warp yarn and 21/2 cc for the fill yarn.

The warp and fill yarns were then used to construct a woven fabric with a 3×1 twill weave construction using conventional methods. After weaving, the woven fabric was dyed in a dye bath to color the FR Rayon fibers present in the fabric and was further stabilized to prevent additional laundry shrinkage. Additionally, a hydrophilic finish was applied to the fabric to provide adequate liquid moisture absorption capability when in use as a garment. The final dyed and finished fabric was medium blue heather color and had a nominal basis weight of 8 oz/$yd^2$. When measured, the fabric had a tear resistance (warp×fill direction) of 27×20 pounds-force and a grab strength (warp×fill) of 170×116 pounds-force. Arc performance testing of this fabric is summarized in Table 1.

Fabric 2

Staple yarns were prepared as for Fabric 1, however, the final yarn size was 21/2 cc for the warp yarn and 14/2 cc for the fill yarn. The fabric was then dyed and processed in the general manner of Fabric 1. The final dyed and finished fabric was a denim blue heather color and had a nominal weight of 9.5 oz/$yd^2$. When measured, this fabric had a tear resistance (warp×fill) of 38×23 pounds-force and a grab strength (warp×fill) of 218×159 pounds-force. Arc performance testing of this fabric is summarized in Table 1.

Fabric 3

Staple yarns and a 3×1 twill fabric were prepared as for Fabric 1, however, the woven fabric was then processed to dye navy blue both the natural color Nomex® amorphous meta-aramid in the Nomex® Type 462 staple and the FR Rayon fiber. Cationic dyes were used to color the meta-aramid fiber and reactive dyes were used to color the FR Rayon fiber. As in Fabric 1, the fabric was further processed to stabilize it in order to maintain adequate dimensional stability in laundry conditions and a hydrophilic finish was applied. The final nominal weight of the dyed and finished fabric was 8 oz/yd$^2$. Measurement resulted in a tear-resistance (warp×fill) of 34×20 pounds-force and a grab strength (warp×fill) of 198×143 pounds-force. Arc performance testing of this fabric is summarized in Table 3.

Comparative Fabric A

Comparative Fabric A was a nominal 7.5 oz/yd$^2$ dark blue fabric commercially available from DIFCO Performance Fabrics, Inc., of Montreal, Quebec, Canada, under the trade name of "Genesis". It is made entirely from Nomex® Type 462 staple fibers, which contain amorphous meta-aramid fibers. When measured, this fabric had a tear resistance (warp×fill) of 53×23 pounds-force and a grab strength (warp×fill) of 287×173 pounds-force. Arc performance testing of this fabric is summarized in Table 1.

Comparative Fabric B

Comparative Fabric B was a nominal 6.5 oz/yd$^2$ royal blue fabric commercially available from Southern Mills, Inc. of Union City, Ga. under the trade name of "ComfortBlend". This fabric is made from an intimate blend of 35 percent by weight flame retardant rayon staple fibers and 65 percent by weight Nomex® Type 462 staple fibers, which contain amorphous meta-aramid fibers. When measured, this fabric had a tear resistance (warp×fill) of 19×10 pounds-force and a grab strength (warp×fill) of 134×87 pounds-force. Arc performance testing of this fabric is summarized in Table 1.

Comparative Fabric C

Comparative Fabric C was a nominal 8.5 oz/yd$^2$ denim blue fabric used in commercially available garments from Workrite Uniform Company of Oxford, Calif., designated Style #410-NMX-85-DN (described as a "denim jean cut pant"). The fabric used in this garment is believed to be made from the combination of Nomex® Type N-302 staple fibers (which contain crystallized meta-aramid fibers) in the warp direction of the fabric; and Nomex® Type T462 staple fibers (which contains amorphous meta-aramid fibers) in the fill direction. When measured, this fabric had a tear resistance (warp×fill) of 89×59 pounds-force and a grab strength (warp×fill) of 414×253 pounds-force. Arc performance testing of this fabric was disclosed in the October 2002 Workrite catalog (pp. 27–28) and is reproduced in Table 1.

Comparative Fabric D

Comparative Fabric D was a nominal 9.5 oz/yd$^2$ solid shade spruce green fabric available commercially from Southern Mills, Inc., of Union City, Ga., under the trade name of "AtEase 950". This fabric is made entirely from Nomex® Type 462 staple fibers. Arc performance testing of this fabric is summarized in Table 1.

Arc Testing

Arc Protection Performance of the fabrics of this invention and comparative fabrics is shown in Table 1. High arc ratings for fabrics is preferred for protective fabrics. The fabrics of this invention have improved Arc Thermal Performance Values (ATPV) per unit basis weight over other fabrics containing FR rayon, while having improved comfort and appearance over 100% aramid blend fabrics.

TABLE 1

| | Fabric | | | | | |
|---|---|---|---|---|---|---|
| | 1 | 2 | A | B | C | D |
| Warp Yarn Composition | 65%/35% CFB/R | 65%/35% CFB/R | 100% AFB | 65%/35% AFB/R | 100% CFB | 100% AFB |
| Fill Yarn Composition | 65%/35% AFB/R | 65%/35% AFB/R | 100% AFB | 65%/35% AFB/R | 100% AFB | 100% AFB |
| Nominal Basis Wt. oz/yd$^2$ | 8.0 | 9.5 | 7.5 | 6.5 | 8.5 | 9.5 |
| Actual Basis Wt. oz/yd$^2$ | 8.5 | 10.2 | 7.8 | 6.8 | 9.2 | 10.5 |
| Arc Rating(ATPV) cal/cm$^2$ | 9.1 | 13.1 | 7.3 | 5.7 | 14.1 | 9.7 |
| Arc Rating Per Unit Basis Wt. (cal/cm$^2$)/(oz/yd$^2$) | 1.07 | 1.28 | 0.94 | 0.84 | 1.53 | 0.92 |

CFB—Crystallized Fiber Blend Nomex ® Type N302
AFB—Amorphous Fiber Blend Nomex ® Type 462
R—Flame Retardant Rayon

EXAMPLE 2

Fabrics 1, 2 and 3 and Comparative Fabrics A and C were tested to obtain their protective performance in a flash fire. The fabrics were constructed into standard pattern coveralls, which were then laundered one time prior to testing on an instrumented thermal mannequin. Testing was conducted using a heat flux of 2 cal/(cm$^2$-s) and cotton undergarments under the coveralls. Results were the average of at least 3 replicate exposures. The results of such testing are shown in Table 2. Lower percent total body burn ratings are preferred. As shown by the table, meta-aramid fabrics that are more attractive and are made more comfortable by the addition of the FR rayon also perform well in protective apparel for flash fires.

TABLE 2

| | Fabric | | | | |
|---|---|---|---|---|---|
| | 1 | 2 | 3 | A | C |
| Warp Yarn Composition | 65%/35% CFB/R | 65%/35% CFB/R | 65%/35% CFB/R | 100% AFB | 100% CFB |
| Fill Yarn Composition | 65%/35% AFB/R | 65%/35% AFB/R | 65%/35% AFB/R | 100% AFB | 100% AFB |
| Nominal Basis Wt. oz/yd$^2$ | 8.0 | 9.5 | 8.0 | 7.5 | 8.5 |
| Total % Predicted Body Burn After: | | | | | |
| 3.0 Seconds | 10.0 | 8.3 | 11.7 | 14.0 | 13.3 |
| 4.0 Seconds | 24.3 | 20.8 | 35.3 | 44.3 | 41.3 |
| 5.0 Seconds | 48.0 | 47.8 | 54.3 | 57.7 | 56.3 |

CFB—Crystallized Fiber Blend Nomex ® Type N302
AFB—Amorphous Fiber Blend Nomex ® Type 462
R—Flame Retardant Rayon

EXAMPLE 3

This example illustrates a woven fabric of this invention made from warp- and fill-direction staple yarns made from intimate blends of staple fiber having a nominal cut length of 2 inches. For the warp-direction yarns, a staple blend containing 65% Nomex® Type N302 staple fibers and 35%

FR Rayon staple fibers by weight of fiber was used. Nomex® Type N302 is a staple blend of 93% producer colored Nomex® (crystallized) meta-aramid fiber, 5% producer colored Kevlar® para-aramid fiber, and 2% carbon core nylon (anti-static) fiber. For the fill-direction yarns, a staple blend containing 65% Nomex Type 462 staple fibers and 35% FR Rayon staple fibers by weight of fiber was used. Nomex® Type 462 is a staple blend of 93% natural color Nomex® (amorphous) meta-aramid fiber, 5% natural color Kevlar® para-aramid fiber, and 2% carbon core nylon (anti-static) fiber. The fiber blends were converted into plied yarns using an air jet spinning process followed by a plying step. The final yarn size was 24/2 cc for the warp yarn and 21/2 cc for the fill yarn.

The warp and fill yarns were then used to construct a woven fabric with a 3×1 twill weave construction using conventional methods. After weaving, the woven fabric was dyed; both the natural color Nomex® amorphous meta-aramid fiber in the Nomex® Type 462 staple and the FR Rayon fiber were dyed by dyeing the fabric sequentially in separate dye baths containing dyes that had affinity for the fiber. Cationic dyes were used to color the meta-aramid fiber and reactive dyes were used to color the FR Rayon fiber. The fabric was further stabilized to prevent additional laundry shrinkage. Additionally, a hydrophilic finish was applied to the fabric to provide adequate liquid moisture absorption capability when in use as a garment. The final dyed and finished fabric was dark navy blue color and had a nominal basis weight of 8 oz/yd$^2$. Arc performance testing of three samples of this fabric, designated as fabrics 3-1, 3-2, & 3-3 (and also comparative fabrics) are summarized in Table 3.

Comparative Fabric AA

Comparative Fabric A was a nominal 7.5 oz/yd$^2$ dark blue fabric commercially available from DIFCO Performance Fabrics, Inc., of Montreal, Quebec, Canada, under the trade name of "Genesis". It is made entirely from Nomex® Type 462 staple fibers, which contain amorphous meta-aramid fibers. When measured, this fabric had a tear resistance (warp×fill) of 53×23 pounds-force and a grab strength (warp×fill) of 287×173 pounds-force.

Comparative Fabric BB

Comparative Fabric B was a nominal 6.5 oz/yd$^2$ royal blue fabric commercially available from Southern Mills, Inc. of Union City, Ga. under the trade name of "ComfortBlend". This fabric is made from an intimate blend of 35 percent by weight flame retardant rayon staple fibers and 65 percent by weight Nomex® Type 462 staple fibers, which contain amorphous meta-aramid fibers. When measured, this fabric had a tear resistance (warp×fill) of 19×10 pounds-force and a grab strength (warp×fill) of 134×87 pounds-force.

Comparative Fabric CC

Comparative Fabric C was a nominal 8.5 oz/yd$^2$ denim blue fabric used in commercially available garments from Workrite Uniform Company of Oxford, Calif., designated Style #410-NMX-85-DN (described as a "denim jean cut pant"). The fabric used in this garment is believed to be made from the combination of Nomex® Type N-302 staple fibers (which contain crystallized meta-aramid fibers) in the warp direction of the fabric; and Nomex® Type T-462 staple fibers (which contains amorphous meta-aramid fibers) in the fill direction. When measured, this fabric had a tear resistance (warp×fill) of 89×59 pounds-force and a grab strength (warp×fill) of 414×253 pounds-force. Arc performance testing of this fabric was disclosed in the October 2002 Workrite catalog (pp. 27–28) and is reproduced in the Table.

Comparative Fabric DD

Comparative Fabric D was a nominal 9.5 oz/yd$^2$ solid shade spruce green fabric available commercially from Southern Mills, Inc., of Union City, Ga., under the trade name of "AtEase 950". This fabric is made entirely from Nomex® Type 462 staple fibers.

TABLE 3

| | Fabric | | | | | | |
|---|---|---|---|---|---|---|---|
| | 3-1 | 3-2 | 3-3 | AA | BB | CC | DD |
| Warp Yarn Composition | 65%/35% CFB/R | 65%/35% CFB/R | 65%/35% CFB/R | 100% AFB | 65%/35% AFB/R | 100% CFB | 100% AFB |
| Fill Yarn Composition | 65%/35% AFB/R | 65%/35% AFB/R | 65%/35% AFB/R | 100% AFB | 65%/35% AFB/R | 100% AFB | 100% AFB |
| Nominal Basis Weight oz/yd$^2$ | 8.0 | 8.0 | 8.0 | 7.5 | 6.5 | 8.5 | 9.5 |
| Actual Basis Weight oz/yd$^2$ | 8.1 | 8.3 | 8.6 | 7.8 | 6.8 | 9.2 | 10.5 |
| Arc Rating(ATPV)cal/cm$^2$ | 12.0 | 10.9 | 9.8 | 7.3 | 5.7 | 14.1 | 9.7 |
| Arc Rating Per Unit Basis Wt. (cal/cm$^2$)/(oz/yd$^2$) | 1.48 | 1.31 | 1.14 | 0.94 | 0.84 | 1.53 | 0.92 |

CFB—Crystallized Fiber Blend Nomex ® Type N302
AFB—Amorphous Fiber Blend Nomex ® Type 462
R—Flame Retardant Rayon

What is claimed is:

1. A fiber blend for use in protective apparel, comprising:

(i) amorphous meta-aramid fiber, (ii) crystallized meta-aramid fiber, and (iii) flame retardant cellulosic fiber wherein the meta-aramid fiber in the blend is in a range from 50 to 85 weight percent and wherein the total amount of meta-aramid fiber is in a range from one-third to two thirds amorphous and in a range from two thirds to one third crystalline by weight.

2. The fiber blend of claim 1 additionally comprising para-aramid fiber.

3. The fiber blend of claim 1 additionally comprising antistatic fiber.

4. The fiber blend of claim 1 wherein the crystallized meta-aramid fiber is pigmented, dyed, or colored.

5. A fabric comprising the fiber blend of claim 1.

6. A protective article comprising the fiber blend of claim 1.

7. The fiber blend of claim 1 wherein the meta-aramid fiber is present in a range from 60 to 75 weight percent.

8. A fabric for use in protective apparel, comprising:

(i) a first yarn comprising amorphous meta-aramid fiber and flame retardant cellulosic fiber, and (ii) a second yarn comprising crystallized meta-aramid fiber and flame retardant cellulosic fiber wherein the meta-aramid fiber in the fabric is in a range from 50 to 85 weight percent and wherein the total amount of meta-aramid fiber is in a range from one-third to two thirds amorphous and in a range from two thirds to one third crystalline by weight.

9. The fabric of claim 8 also containing para-aramid fiber.

10. The fabric of claim 8 also containing antistatic fiber.

11. The fabric of claim 8 wherein the yarns comprising crystallized meta-aramid fiber are pigmented, dyed, or colored.

12. The fabric of claim 8 wherein the yarns comprising amorphous meta-aramid fiber are dyed.

13. The fabric of claim 8 wherein the yarns comprising amorphous meta-aramid fiber are present transverse to the yarns comprising crystallized meta-aramid fiber.

14. The fabric of claim 13 wherein the yarns comprising crystallized meta-aramid fiber are pigmented, dyed, or colored.

15. The fabric of claim 13 wherein the yarns comprising amorphous meta-aramid fiber are dyed.

16. A protective article comprising the fabric of claim 13.

17. The fiber of claim 8 wherein the meta-aramid fiber is present in a range from 60 to 75 weight percent.

* * * * *